US012650026B1

(12) United States Patent
Shofner

(10) Patent No.: US 12,650,026 B1
(45) Date of Patent: Jun. 9, 2026

(54) SYSTEM FOR LIFTING A STRUCTURE INTO AN ELEVATED POSITION

(71) Applicant: William Kent Shofner, Venice, FL (US)

(72) Inventor: William Kent Shofner, Venice, FL (US)

( * ) Notice: Subject to any disclaimer, the term of this patent is extended or adjusted under 35 U.S.C. 154(b) by 0 days.

(21) Appl. No.: 19/280,529

(22) Filed: Jul. 25, 2025

(51) Int. Cl.
*E04H 9/14* (2006.01)
*E04H 1/12* (2006.01)

(52) U.S. Cl.
CPC ..... *E04H 9/145* (2013.01); *E04H 1/1205* (2013.01); *E04H 2001/1283* (2013.01)

(58) Field of Classification Search
CPC ..... E04H 2001/1283; E04H 1/1205; E04H 9/145; E04B 1/34352
See application file for complete search history.

(56) References Cited

U.S. PATENT DOCUMENTS 5,775,847 A * 7/1998 Carlinsky ..... E02D 27/32 52/169.9
6,379,085 B1 * 4/2002 Vanderklaauw ..... E04G 1/17 405/230
10,081,962 B1 * 9/2018 Sluss ..... E02D 27/06
2015/0121778 A1 * 5/2015 Rawding ..... E04H 9/145 52/169.9
2015/0247333 A1 * 9/2015 Padtsialezhnikau .... E04H 9/145 114/265
2019/0249413 A1 * 8/2019 Brotherton ..... E04B 1/0007
2020/0070937 A1 * 3/2020 Hedberg ..... E04B 1/36
2024/0240446 A1 * 7/2024 Ethier ..... E04B 1/38

FOREIGN PATENT DOCUMENTS

CA 2931719 A1 * 11/2017
DE 877494 C * 5/1953
DE 10234049 A1 * 2/2004 ..... E04B 1/34363
EP 3283715 B1 * 12/2018 ..... E04B 1/3408

* cited by examiner

*Primary Examiner* — Christine T Cajilig
(74) *Attorney, Agent, or Firm* — Bryan L. Loeffler, esq.; Loeffler IP Group, PA

(57) ABSTRACT

A system for lifting a structure above flood water during storm surges and other severe weather events wherein the structure has a reinforced support frame that is slidably attached to multiple vertical poles positioned around the structure. The structure may be raised up and down the poles using an automated lifting mechanism or by one or more floating pontoons secured below the structure that rise and fall with any flood waters.

5 Claims, 5 Drawing Sheets

SYSTEM FOR LIFTING A STRUCTURE INTO AN ELEVATED POSITION

FIELD OF THE INVENTION

This invention relates generally to and, more particularly, to a system capable of lifting structures into raised positions where the structures are safe from storm surges and flood waters.

BACKGROUND OF THE INVENTION

Flooding affects a large number of homes every year. The repair cost of repeatedly fixing and/or replacing flooded structures is quite high. In addition, newer building codes greatly limit the types of homes that may be built in flood prone areas. For example, many coastal areas have introduced codes that require all new construction to be raised on stilts. This requirement eliminates many lower-cost housing options, such as mobile homes, modular homes, tiny houses, and storage container homes, from being placed in these areas. These limitations not only apply to brand new residential lots, but also to existing residential lot owners are not allowed to replace damaged mobile homes with new mobile homes. This has resulted in pricing many lot owners out of rebuilding and/or replacing their homes when destroyed in floods, thus having an especially detrimental effect on trailer parks and mobile home parks.

Therefore, it would be highly desirable to provide a cost-effective method for lifting structures into elevated positions out of the reach of storm surge and flood water.

SUMMARY OF THE INVENTION

The primary object of the present invention is to provide a system for lifting structures above flood water during storm surges and other severe weather events.

An additional object of the present invention is to provide a structure having a bottom support frame that allows the structure to be lifted from a central point without comprising the structural integrities of the walls and roof.

The present invention fulfills the above and other objects by providing a structure having a reinforced support frame that is slidably attached to multiple vertical poles positioned around the structure. The structure may be raised up and down the poles using a hydraulic lift, equivalent mechanism, or by one or more floating pontoons.

Utilities supplied to the structure are preferably detachable, thereby allowing water, electricity, sewer, cable, etc. to be temporarily disconnected from the structure in the event of a storm surge or other flooding. As a result of the utilities being disconnected and/or down, the structure will not have electricity to power air conditioning, a dehumidifier, or a refrigerator. Therefore, a solar panel is provided to provide an energy source that provides electricity directly to one or more appliances or via one or more batteries that are charged by the solar panel, which are all connected by a solar circuit. The one or more appliances preferably compromise a dehumidifier, an air conditioner, and/or a refrigerator. When the structure is lifted and disconnected from an electrical service, the solar circuit is activated so the interior of the structure will not be exposed to humidity, and so forth.

A shipping container in shown and described throughout as a preferred embodiment of the structure, however, the structure may also be of any construction as long as the structure is supported by a reinforced base or chassis, such as a chassis found on a mobile home.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
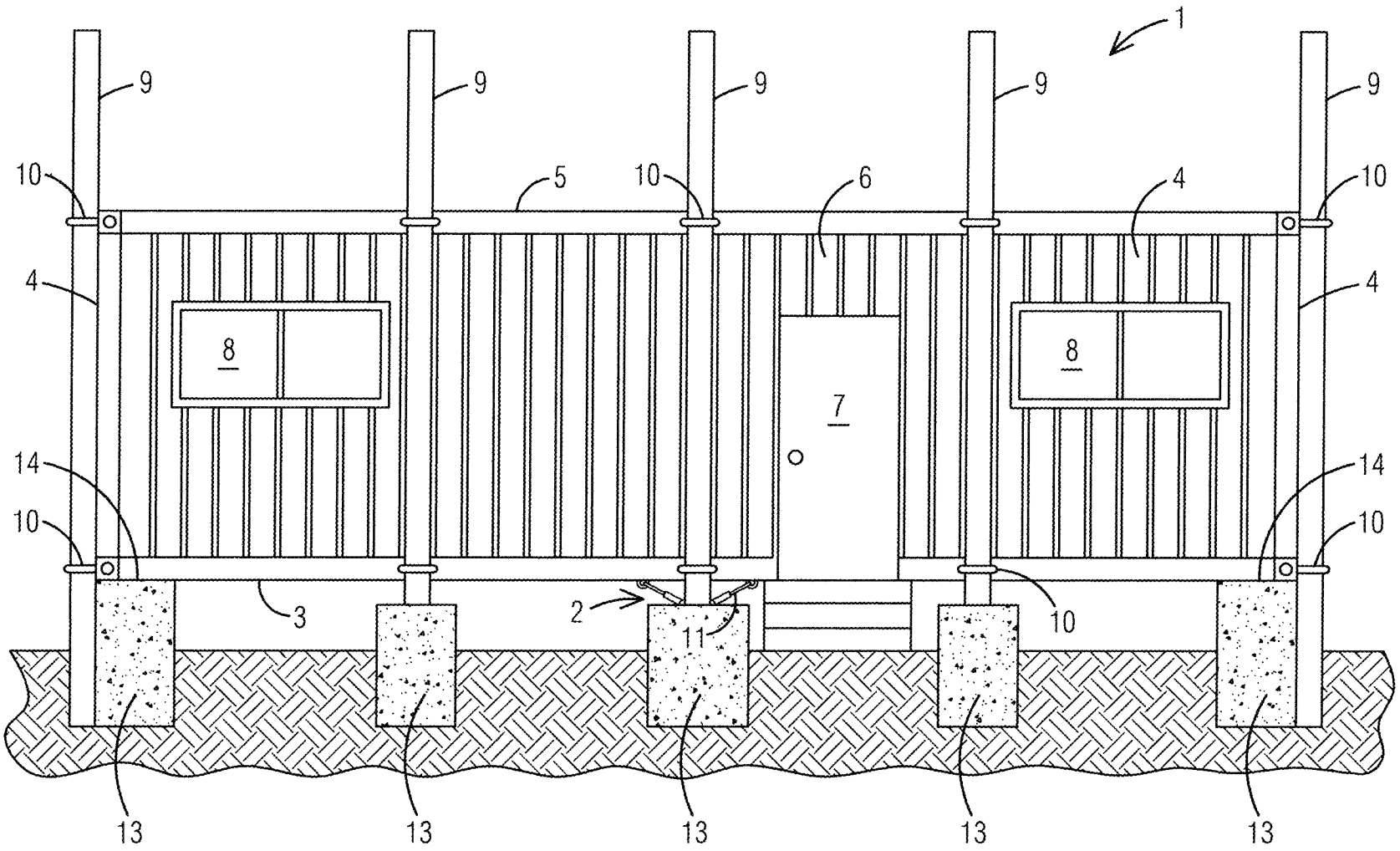
FIG. 1 is a front view of a structure with lifting system of the present invention.
Figure 2:
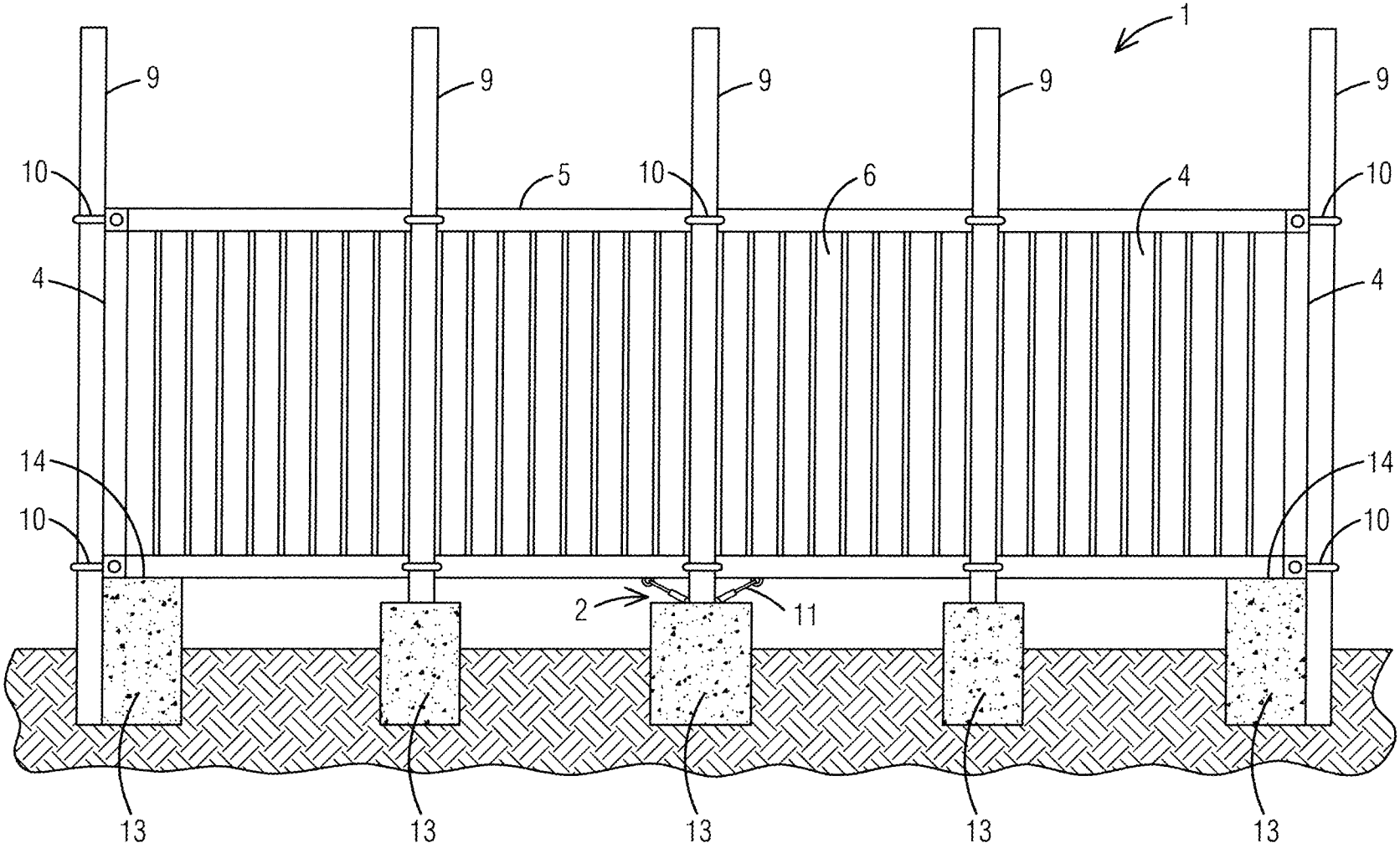
FIG. 2 is a rear view of the structure with lifting system of the present invention.
Figure 3:
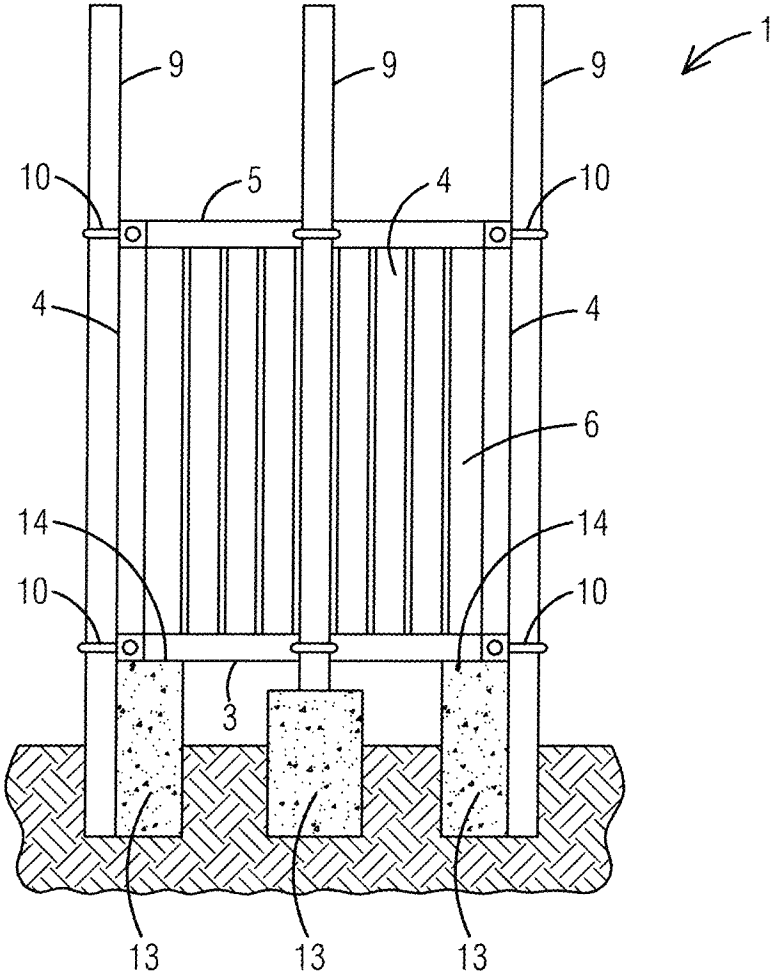
FIG. 3 is right side view and mirror image of a left side view of the structure with lifting system of the present invention.
Figure 4:
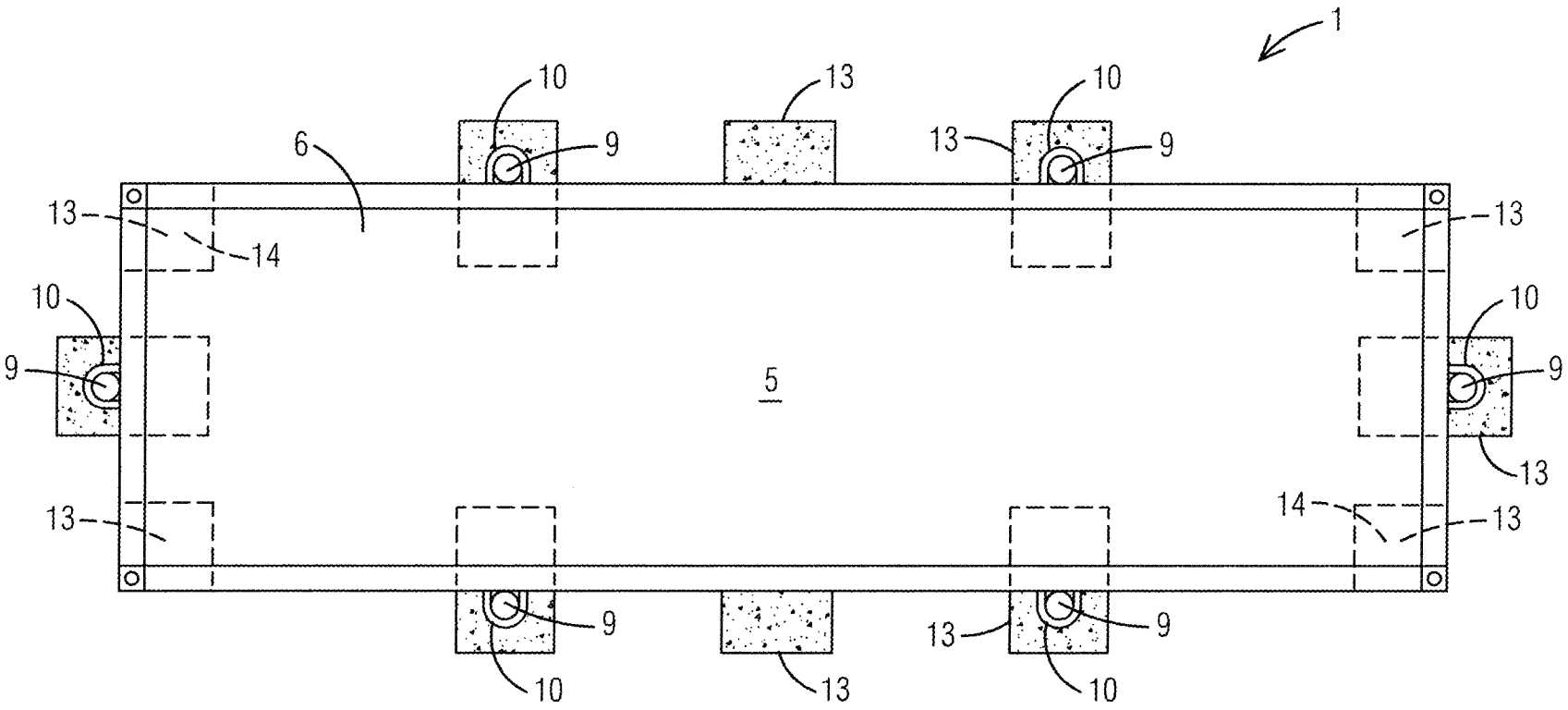
FIG. 4 is a top plan view of the structure with lifting system of the present invention.

For purposes of describing the preferred embodiment, the terminology used in reference to the numbered accessories in the drawings is as follows:

1. structure, generally
2. lifting system
3. bottom support frame
4. wall
5. roof
6. shipping container
7. door
8. window
9. vertical pole
10. attachment means
11. lifting means
12. pontoon
13. foundation pillar
14. ledge of foundation pillar With reference to FIGS. 1-4, a structure 1 with a lifting system 2 of the present invention is illustrated. The structure 1 of the present invention comprises a reinforced bottom support frame 3 capable of supporting the walls 4 and roof 5 of structure 2 in a raised position off of the ground. The bottom support frame 3 preferably comprises a plurality of side rails and cross members that create a rigid body that supports the weight of the walls 4 and roof 5 of the structure 1. As illustrated herein, the structure 1 is a conventional shipping container 6 that has been converted into a livable home having doors 7, windows 8, and interior walls. In addition, the shipping container 6 comprises an integrated reinforced bottom support frame 3 that allows the shipping container 6 structure1 to be lifted without compromising the structural integrity of walls 4 and roof 5.

A plurality of vertical poles 9 are positioned around the structure 1, wherein the structure 1 is slidably attached to the poles 9 via C-shaped brackets, U-shaped brackets, rings, or other attachment means 10, which are secured to exterior surfaces of the bottom support frame 3 and to exterior surfaces of the walls 4.

A lifting means 11 is preferably positioned in a central location under the bottom support frame 3 to allow the entire structure 1 to be lifted into an elevated position on the vertical poles 9, which act as guides. The lifting means 11 may be a hydraulic lift, a mechanical lift, an electric lifts, or any equivalent thereof. Using the lifting means 11, the structure 1 may be raised up into a locked position and elevated position on the poles 9 prior to a storm surge or other flooding to prevent damage to the structure 1. Likewise, the structure 1 may be lowered back onto the ground or foundation pillars 13 using the lifting means 11.

Figure 5:
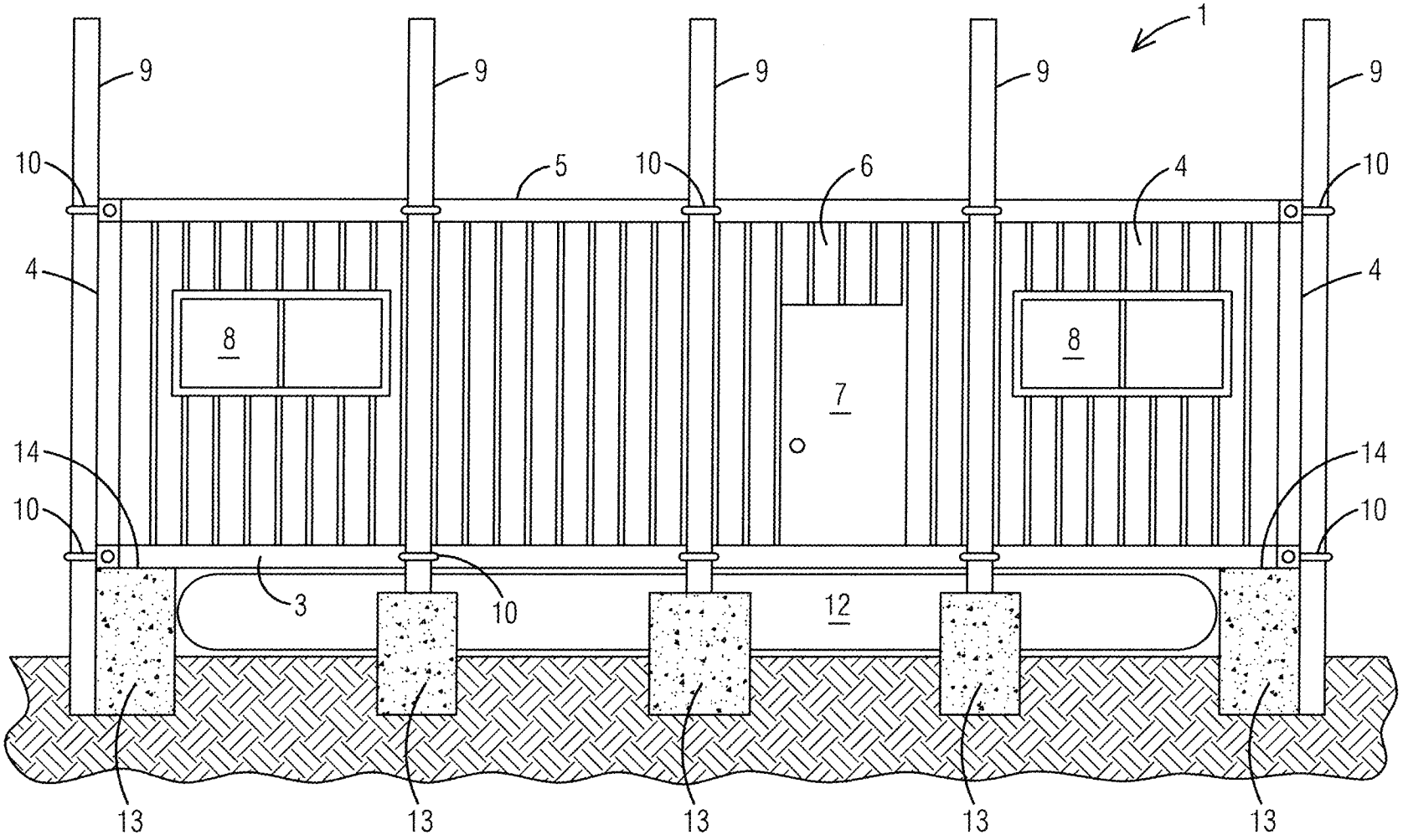
FIG. 5 is a front view of a structure with lifting system of the present invention wherein pontoon floats are used as the lifting mechanism.

Alternatively, as illustrated in FIG. 5, one or more pontoons 12 may be used as a lifting means 11 to raise the structure 1 into an elevated position. The one or more pontoons 12 will float on top of any flood water, thereby causing the structure 1 to rise and fall on top of the flood water.

As illustrated throughout FIGS. 1-5, the structure 1 is preferably supported by a plurality of foundation pillars 13 spaced around an outer perimeter of the structure 1 wherein the bottom support frame 3 rests on the foundation pillars 13 while in a lowered position, thereby taking any stress off of the vertical poles 9. In addition, the plurality of foundation pillars 13 may also support the vertical poles 9 by anchoring bottom ends of the vertical poles 9 into the ground. The vertical poles 9 are each preferably located in an offset position on each respective foundation pillar 13 to provide a ledge 14 on which the bottom support frame 3 rests while the structure 1 is in a lowered position.

Utilities supplied to the structure 1 are preferably detachable from the structure 1, thereby allowing water supplies, electricity, sewer, cable, etc. to be temporarily disconnected from the structure in the event of a storm surge or other flooding.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A system for lifting a structure into an elevated position for protection from flood water, said system comprising:

a structure having a roof and walls supported by a bottom support frame capable of supporting the walls and roof during movement from a lowered position to a raised position wherein the structure is elevated off of a plurality of foundation pillars;

wherein the structure is lifted into a raised position by at least one lifting means positioned below the bottom support frame;

a plurality of vertical poles positioned around the structure;

said structure is a conventional shipping container that has been converted into a livable home having one or more doors, windows, and interior walls;

said plurality of foundation pillars are spaced around an outer perimeter of the structure wherein the bottom support frame rests on the foundation pillars while the structure is in a lowered position, thereby taking any stress off of the lifting means;

wherein the foundation pillars also support said vertical poles in upright positions; and wherein said vertical poles are each located in an offset position on each respective foundation pillar to provide ledges on which the bottom support frame of the structure rests while the structure is in a lowered position.

2. The system of claim 1 wherein:

said lifting means is a hydraulic lift.

3. The system of claim 1 wherein:

said lifting means is at least one pontoon.

4. The system of claim 1 further comprising:

a solar circuit that activates when the structure is raised into an elevated position to power a dehumidifier inside the structure.

5. The system of claim 1 further comprising:

a solar circuit that activates when the structure is raised into an elevated position to power a refrigerator inside the structure.

* * * * *